US009341069B2

(12) United States Patent
Valiente et al.

(10) Patent No.: US 9,341,069 B2
(45) Date of Patent: May 17, 2016

(54) GAS TURBINE

(75) Inventors: Ruben Valiente, Madrid (ES); Shailendra Naik, Gebenstorf (CH); Andre Saxer, Mellingen (CH)

(73) Assignee: GENERAL ELECTRIC TECHNOLOGYY GMBH, Baden (CH)

( * ) Notice: Subject to any disclaimer, the term of this patent is extended or adjusted under 35 U.S.C. 154(b) by 0 days.

(21) Appl. No.: 13/239,549

(22) Filed: Sep. 22, 2011

(65) Prior Publication Data

US 2012/0087782 A1 Apr. 12, 2012

Related U.S. Application Data

(63) Continuation of application No. PCT/EP2010/053670, filed on Mar. 22, 2010.

(30) Foreign Application Priority Data

Mar. 23, 2009 (EP) ..... 09155854

(51) Int. Cl.
*F01D 5/08* (2006.01)
*F01D 5/30* (2006.01)

(52) U.S. Cl.
CPC ..... *F01D 5/3007* (2013.01); *F01D 5/081* (2013.01); *F01D 5/087* (2013.01)

(58) Field of Classification Search
CPC ..... F01D 5/14; F01D 5/143; F01D 5/18; F01D 5/3007; F01D 25/12; F01D 5/081; F01D 5/087; F05D 2240/301
USPC ..... 415/115, 116; 416/95, 96 R, 97 A, 97 R
See application file for complete search history.

(56) References Cited

U.S. PATENT DOCUMENTS 2,648,520 A * 8/1953 Schmitt ..... 416/92
2,657,902 A 11/1953 Williams (Continued)

FOREIGN PATENT DOCUMENTS

EP 0718467 A1 6/1996
EP 1041246 A1 10/2000

(Continued)

OTHER PUBLICATIONS

European Patent Office, Extended European Search Report in European Patent Application No. 09 15 5854 (Jul. 30, 2009).

(Continued)

*Primary Examiner* — Sean J Younger
(74) *Attorney, Agent, or Firm* — Buchanan Ingersoll & Rooney PC

(57) ABSTRACT

A gas turbine includes a rotor having a rotor groove and a rotor bore extending through the rotor, the rotor bore having a diffuser-shaped rotor bore exit. A blade is attached to the rotor and includes a blade tip having at least one dust hole. An airfoil has a leading edge and a trailing edge extending along a longitudinal axis of the blade between a lower end of the airfoil and the blade tip. A blade root is disposed at the lower end of the airfoil and is configured to be removably disposed in the rotor groove. The blade root includes a blade inlet having a cross sectional area that exceeds a cross sectional area of the rotor bore in at least one direction. A hollow blade core is disposed in the airfoil and extends along the longitudinal axis of the blade between the blade root and the blade tip.

17 Claims, 3 Drawing Sheets

(56) References Cited

U.S. PATENT DOCUMENTS

| | | | | | |
|---|---|---|---|---|---|
| 2,951,340 | A | * | 9/1960 | Howald | 60/806 |
| 3,370,830 | A | * | 2/1968 | Harper et al. | 416/95 |
| 3,749,514 | A | | 7/1973 | Welcer et al. | |
| 3,918,835 | A | * | 11/1975 | Yamarik et al. | 416/95 |
| 4,017,209 | A | * | 4/1977 | Bodman | 416/97 R |
| 4,177,010 | A | * | 12/1979 | Greaves et al. | 416/97 R |
| 4,344,738 | A | * | 8/1982 | Kelly et al. | 416/95 |
| 4,501,053 | A | * | 2/1985 | Craig et al. | 29/889.721 |
| 4,820,122 | A | * | 4/1989 | Hall et al. | 416/97 R |
| 4,820,123 | A | * | 4/1989 | Hall | 416/97 R |
| 5,888,049 | A | * | 3/1999 | Broadhead et al. | 416/96 R |
| 6,565,318 | B1 | | 5/2003 | Tiemann | |
| 6,735,956 | B2 | * | 5/2004 | Romani | 60/806 |
| 6,874,992 | B2 | | 4/2005 | Dailey | |
| 7,059,825 | B2 | * | 6/2006 | Magowan et al. | 415/115 |
| 7,097,419 | B2 | * | 8/2006 | Lee et al. | 415/115 |
| 7,264,445 | B2 | * | 9/2007 | Naik et al. | 416/97 R |
| 7,632,071 | B2 | * | 12/2009 | Charbonneau et al. | 416/92 |
| 7,762,774 | B2 | * | 7/2010 | Liang | 416/97 R |
| 2002/0090298 | A1 | | 7/2002 | Beeck et al. | |

FOREIGN PATENT DOCUMENTS

| | | | |
|---|---|---|---|
| FR | 2152437 | A1 | 4/1973 |
| GB | 611044 | A | 10/1948 |
| GB | 868788 | A | 5/1961 |
| JP | 59051103 | A | 3/1984 |
| RU | 2323343 | C2 | 4/2008 |

OTHER PUBLICATIONS

European Patent Office, International Search Report in International Patent Application No. PCT/EP2010/053670 (May 25, 2010).

Russian Office Action issued in corresponding Russian Application No. 2011142732 dated Dec. 26, 2013 with translation.

Zhirickij et al ., "Gazovye turbiny aviacionnyh dvigatelej", Moscow, oborongiz, 1963, p. 378, fig. 9.29.

Office Action (Decision on Grant) issued on Jun. 17, 2014, by the Russian Patent Office in corresponding Russian Application No. 2011142732, and an English Translation of the Office Action. (11 pages).

Office Action issued on Mar. 20, 2015, by the Korean Patent Office in corresponding Korean Application No. 10-2011-7022161, and an English Translation of the Office Action.

* cited by examiner

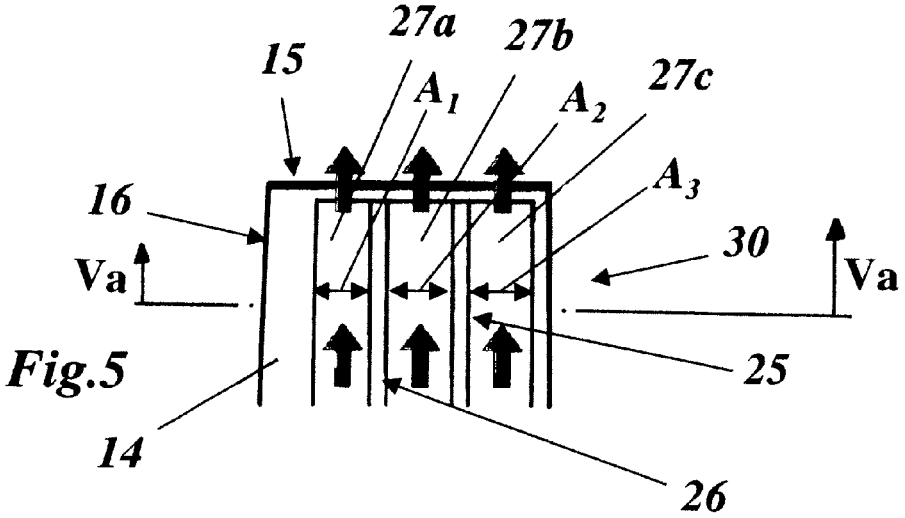
Fig.5
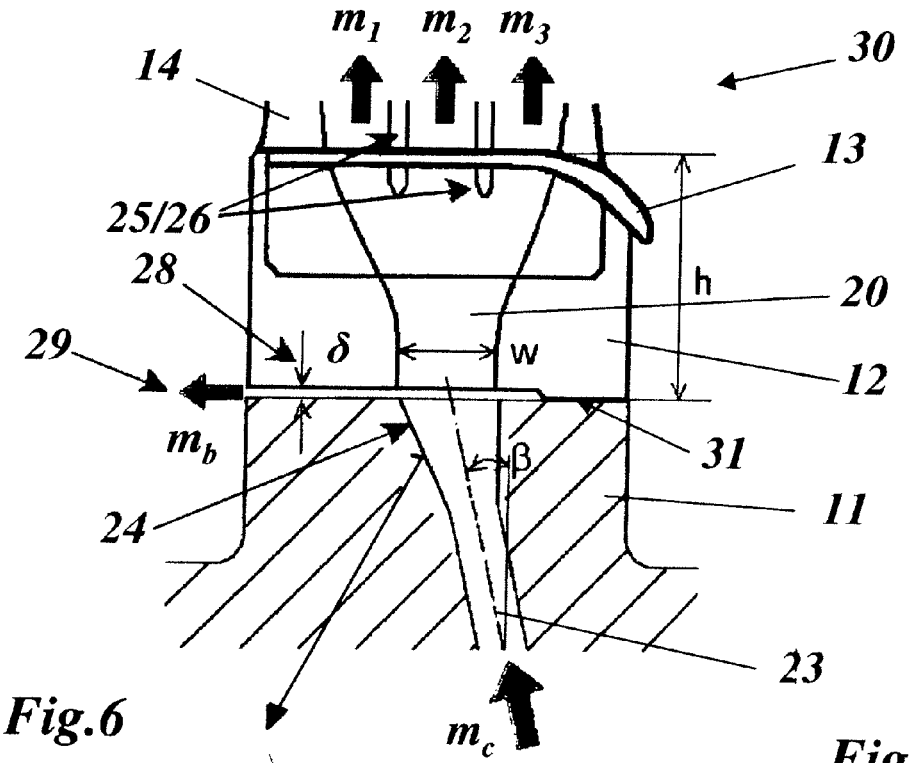
Fig.6
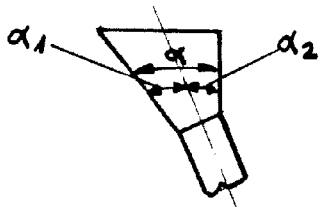
Fig. 5 a
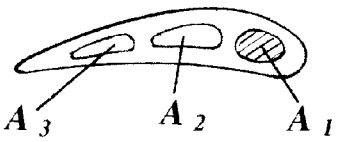

GAS TURBINE

CROSS REFERENCE TO PRIOR APPLICATIONS

This application is a continuation of International Application No. PCT/EP2010/053670, filed on Mar. 22, 2010, which claims priority to European Application No. EP 09155854.4, filed on Mar. 23, 2009. The entire disclosure of both applications is incorporated by reference herein.

FIELD

The present invention relates to gas turbines.

BACKGROUND

It is a practice to provide blades or vanes of gas turbines with some form of cooling in order to withstand the high temperatures of the hot gases flowing through such turbines. Typically, cooling ducts are provided within the airfoil of the blades or vanes, which are supplied in operation with pressurised cooling air derived from the compressor part of the gas turbine. Usually, the cooling ducts have the convoluted form of a serpentine, so that there is one flow of cooling fluid or cooling air passing through the airfoil in alternating and opposite directions. However, such a convoluted passageway necessarily requires bends, which give rise to pressure losses without heat transfer. Furthermore, as there is only one flow of cooling fluid, it is difficult to adapt this flow to the various cooling requirements existing at different locations of the airfoil.

To achieve more flexibility in the cooling of the airfoil, it has been described (U.S. Pat. No. 6,874,992) to provide the airfoil with a plurality of cooling passages comprising a plurality of inlet passages along which cooling air flows from the base towards the tip region of the blade and a plurality of return passages along which cooling air flows from the tip towards the base region of the blade, whereby at least some of said inlet and return passages being connected by a common chamber located within the tip region of the blade.

However, as these cooling passages are in fluid communication with each other by means of said common chamber located within the tip region of the blade, it is still difficult to adjust the individual mass flows of cooling fluid flowing through the various cooling passages.

Another problem recognized by the present invention, which is related to the supply of the cooling fluid through the root of the blade or vane, may be explained with reference to FIGS. 1-3:

According to FIG. 1, a blade 10 of a gas turbine comprises an airfoil 14 with a leading edge 17 and a trailing edge 16. The airfoil 14 extends along a longitudinal axis X of said blade between a lower end and a blade tip 15. At the lower end of said airfoil 14, a blade root 12 is provided for being attached to a groove 31 in a rotor 11 of said gas turbine. A hollow blade core 18 is arranged within said airfoil 14 and extends along the longitudinal axis X between said blade root 12 and said blade tip 1. The blade core 18 is provided for the flow of a cooling fluid, which enters said blade core 18 through a blade inlet 20 at said blade root 12 and exits said blade core 18 through at least one dust hole at said blade tip 15. The cooling fluid (cooling air) is supplied by means of a rotor bore 19, which runs through the rotor 11 and is in fluid communication with said blade inlet 20 of said blade 10.

As shown in FIG. 1, the direction of the rotor bore 19 is aligned with the blade orientation, i.e. the longitudinal axis X. A unique passage smoothly distributes the flow all over the cross section of the duct further above the blade inlet 20. However, the area/shape of the rotor bore exit 19, which is cylindrical, and the inlet 20 of the blade, which is race-track shaped, are different, leading to a non-continuous interface (see FIG. 3, the common area is shaded).

SUMMARY OF THE INVENTION

In an embodiment of the present invention, a gas turbine includes a rotor having a rotor groove and a rotor bore extending through the rotor, the rotor bore having a diffuser-shaped rotor bore exit. A blade is attached to the rotor and includes a blade tip having at least one dust hole. An airfoil has a leading edge and a trailing edge extending along a longitudinal axis of the blade between a lower end of the airfoil and the blade tip. A blade root is disposed at the lower end of the airfoil and is configured to be removably disposed in the rotor groove. The blade root includes a blade inlet having a cross sectional area that exceeds a cross sectional area of the rotor bore in at least one direction. A hollow blade core is disposed in the airfoil and extends along the longitudinal axis of the blade between the blade root and the blade tip. The blade core is configured to receive a cooling fluid from the rotor bore which is in fluid communication with the blade root at an interface between the rotor bore and the blade inlet. A cross sectional area of the diffuser-shaped rotor bore exit covers the cross sectional area of the blade inlet at the interface and the cooling fluid enters the blade core through the blade inlet and exits the blade core through the at least one dust hole.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 5 shows in a side view a detail of the blade tip of a blade according to a second embodiment of the invention with a plurality of individually adjustable parallel cooling ducts;

FIG. 5*a* shows a flow cross section of FIG. 5 and

FIG. 6 shows in a side view a detail of the blade root of the blade according to FIG. 5 with a bleeding interface plenum at the interface between the blade root and the bottom of the root-receiving rotor groove, including a focusing figure of the diffuser with the both angles $\alpha_1$ and $\alpha_2$.

DETAILED DESCRIPTION

Figure 1:
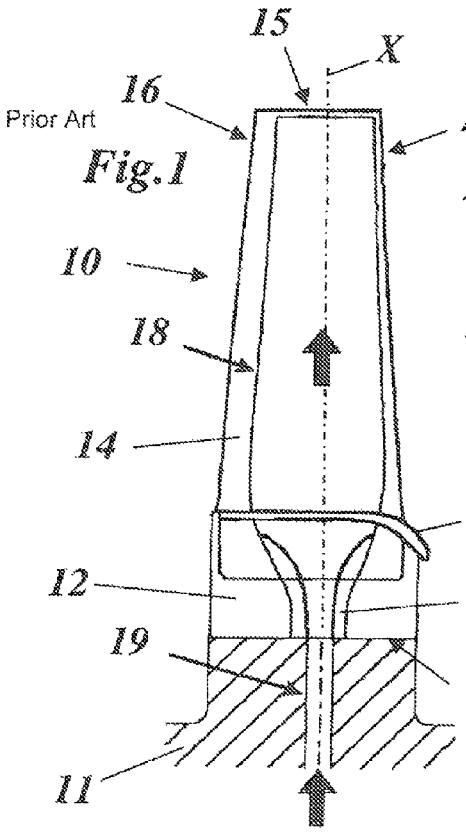
Prior Art Fig.1
FIG. 1 shows a side view of a cooled rotor blade according to a first embodiment of a previous blade with a longitudinally extending rotor bore.
Figure 2:
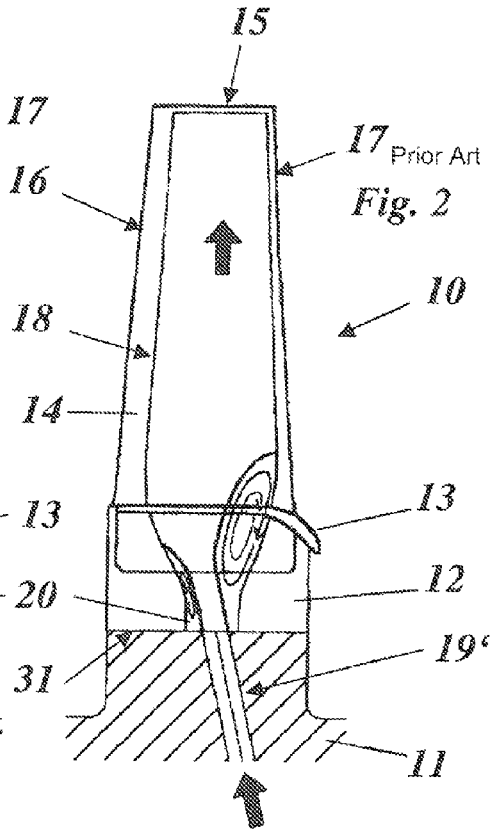
Prior Art Fig. 2
FIG. 2 shows a side view of a cooled rotor blade according to a second embodiment of a previous blade with an obliquely oriented rotor bore.
Figure 3:
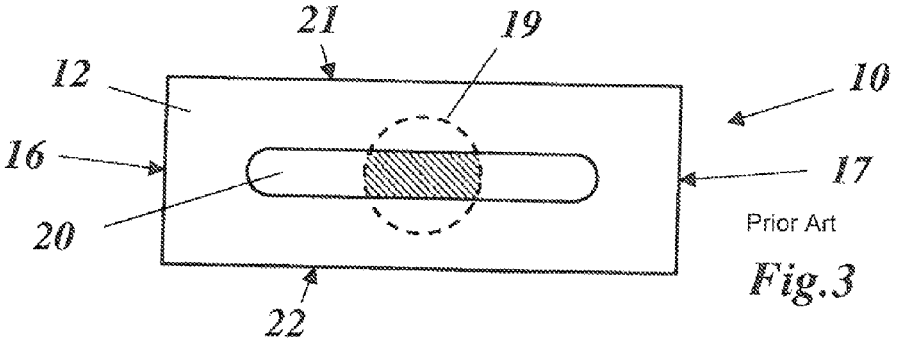
Prior Art Fig.3
FIG. 3 shows the mismatch between the rotor bore exit and the blade inlet in a previous blade according to FIG. 1 or 2.

The problems recognized by the present invention in the blade design shown in FIGS. 1-3 include:

(a) The flow accelerates through the relatively small common area between the exit of the rotor bore 19 and the blade inlet 20. This produces flow separation near the blade inlet 20, leading to local low values of the internal heat transfer coefficient. Hot metal temperature regions may be detected further downstream of the blade. In addition, the pressure loss is increased.

(b) The orientation of the rotor bore 19 is not flexible. If positioned inclined with respect to the blade (see rotor bore 19' in FIG. 2), the flow separation area gets expanded and the situation worsens. This is particularly critical if the flow separation zone extends above the inner diameter platform 13 of the blade 10 (FIG. 2).

(c) Since the flow does not get uniform up to a height far enough from the blade inlet 20, no webs can be positioned below the inner diameter platform 13. Therefore, this configuration does not allow to having a multi-pass design.

In an aspect of the present invention, a gas turbine is provided with a cooled blade, which allows for a flexible design and rating of the cooling passages, and especially allows for a multi-pass design.

In an embodiment, a rotor bore is provided with a diffuser-shaped rotor bore exit, such that the cross section area of the rotor bore exit at the interface between rotor bore and blade inlet covers the cross section area of the blade inlet.

According to one embodiment of the invention, an interface plenum is provided at the interface of said blade inlet and said rotor bore exit between the bottom surface of said blade root and the upper surface of said blade-root-receiving rotor groove, said interface plenum being designed to have a plenum bleed of cooling fluid to the outside of the blade root at the leading edge side or trailing edge side. Advantageously, said blade root has a blade root height h in longitudinal direction, and said interface plenum has a plenum gap $\delta$ with a ratio $\delta/h$ of $0.02 \leq \delta/h \leq 0.05$, and preferably $\delta/h=0.03$.

According to another embodiment of the invention, said blade core is split into a plurality of parallel cooling fluid ducts, wherein each of said cooling fluid ducts is in fluid communication with said blade inlet and has a dust hole at said blade tip, wherein a plurality of longitudinally extending not necessarily parallel webs is provided within said blade core for splitting said blade core into said plurality of cooling fluid ducts, and wherein, for an optimized cooling of said blade, an individual cross section area and an individual cooling fluid mass flow is associated with each of said plurality of cooling fluid ducts. Advantageously, said individual cross section areas and/or said individual cooling fluid mass flows of said cooling fluid ducts are equal within ±25%.

According to another embodiment of the invention, said rotor bore is obliquely positioned in a axial plane with respect to said longitudinal axis of said blade, wherein the angle $\beta$ of deviation between said rotor bore and said longitudinal axis is in the range $0° < |\beta| \leq 30°$, and preferably $\beta=13°$.

According to another embodiment of the invention, said diffuser-shaped rotor bore exit has a diffuser angle $\alpha$, consisting of the angles $\alpha_1$ and $\alpha_2$. The diffuser can be symmetrical, for example $\alpha_1=11°$ and $\alpha_2=11°$, or non-symmetrical as defined by $\alpha_1$ and $\alpha_2$. According to this the angular aperture of the both angles can be $7° \leq \alpha_1 \leq 13°$, and $7° \leq \alpha_2 \leq 13°$.

According to another embodiment of the invention, said blade root has a blade root height h in longitudinal direction, said blade inlet has a maximum width w, and the ratio h/w is $2.0 \leq h/w \leq 3.5$, preferably $h/w=2.5$.

According to the invention several measures are taken (FIG. 4-6), that substantially contribute to solve the problems/limitations described above:

(a) An interface plenum 28 (FIG. 6) is created underneath the blade inlet 20 of the blade 30 by leaving some gap 6 between the rotor upper surface in the rotor groove 23 and the bottom surface of the blade root 12, confined by the fir-tree of the rotor 11.

(b) The rotor bore exit 24 is reworked with a diffuser-shaped (conical) form extending over the whole width w of the blade inlet 20.

(c) A part of the cooling fluid flow is conveniently bled from the leading edge side (17) or trailing edge side (16) of the plenum slot (28).

Both the interface plenum 28 and the diffuser-shaped rotor bore exit 24 acting to decelerate the cooling fluid flow and to extend it along the whole width w of the blade inlet 20. The bleeding flow from the interface plenum slot 28 supports this task (especially if the rotor bore 23 is inclined).

Figure 4:
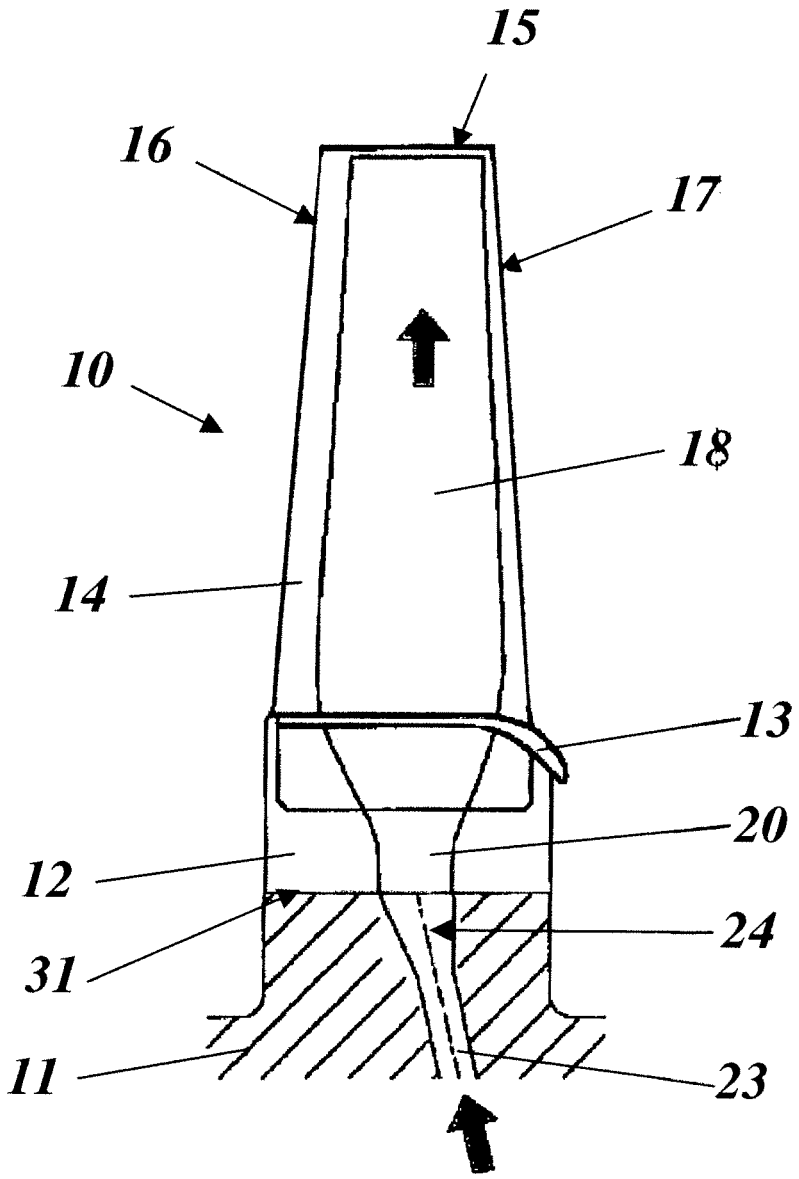
FIG. 4 shows a side view of a cooled rotor blade according to an embodiment of the invention with an obliquely oriented rotor bore comprising a diffuser-shaped rotor bore exit.

The benefits of this configuration are:

(a) By the time the coolant reaches the inlet section of the blade 10, flow conditions are quite even all over the cross-section of the blade inlet 20. The coolant is therefore better distributed across the entire cross-section of the blade 30, mitigating or cancelling the presence of flow separation (FIG. 4). If flow separation still exists, it is confined well below the inner diameter platform 13 anyway, even for quite short shanks.

(b) Inlet pressure losses are reduced.

(c) The stream manages to quickly adapt to the orientation of the blade 10 regardless of the feed direction of the rotor bore 23. As a consequence, the invention allows inclining the rotor bore 23 feeding the blade 10 if the rotor design requires so (FIG. 4).

(d) Further, as the feed coolant conditions are already quite uniform sufficiently below the inner diameter platform 13, the invention allows the introduction of webs 25, 26 for a multi-pass cooling design with independent passages (blade 30 in FIG. 5, 6). In particular, a 3-pass design with two webs 25, 26 and three parallel ducts 27*a*, 27*b* and 27*c* is chosen as best compromise between cooling effectiveness and weight. Such a design is more effective than the current unique passage design, because it allows a better control of the local mass flow $m_1$, $m_2$, and $m_3$ through the entire core section 18. The control of the flow split through each of the ducts 27*a*, 27*b* and 27*c* is done with dust holes positioned at the blade tip 15 (see arrows at the blade tip in FIG. 5), which can be size-customized independently. This design adds in addition cold material to the cross-section to successfully carry a blade shroud if required.

(e) All benefits mentioned above are managed with very little change/redesign of the blade.

For an optimized cooling of the 3-pass blade 30 in FIG. 5, 6 an individual cross section area $A_1$, $A_2$, $A_3$ and an individual cooling fluid mass flow $m_1$, $m_2$, $m_3$ is associated with each of ducts 27*a*, 27*b*, 27*c*. Favourably, the individual cross section areas $A_1$, $A_2$, $A_3$ and/or the individual cooling fluid mass flows $m_1$, $m_2$, $m_3$ of the ducts 27*a*, 27*b*, 27*c* are chosen to be equal with each other within ±25%.

Furthermore it is advantageous that the rotor bore 23 is obliquely positioned in a axial plane with respect to the longitudinal axis X of the blade 10, 30, whereby the angle $\beta$ of deviation between the rotor bore 23 and the longitudinal axis X is in the range $0° < |\beta| \leq 30°$. Preferably, $\beta=13°$.

It is also advantageous, that the diffuser-shaped rotor bore exit 24 has a diffuser angles $\alpha_1$ and $\alpha_2$. The diffuser can be symmetrical, for example $\alpha_1=11°$ and $\alpha_2=11°$, or non-symmetrical as defined by $\alpha_1$ and $\alpha_2$. According to this the angular aperture of the both angles can be $7° \leq \alpha_1 \leq 13°$, and $7° \leq \alpha_2 \leq 13°$.

Preferably, the blade root 12 has a blade root height h in longitudinal direction, and the interface plenum 28 has a plenum gap δ, such that the ratio δ/h is in the range of $0.02 \leq \delta/h \leq 0.05$, and preferably $\delta/h=0.03$. This leads to a plenum bleed flow $m_b$, which is a fixed part of the cooling supply flow $m_s$ with a ratio of $m_b/m_s=0.2\pm20\%$.

Finally, the blade root 12 has a blade root height h in longitudinal direction, and the blade inlet 20 has a maximum width w, and the ratio h/w lies in the range $2.0 \leq h/w \leq 3.5$, and is preferably h/w=2.5.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

10,30 Blade (gas turbine)
11 Rotor
12 Blade root
13 Platform (inner diameter)
14 Airfoil
15 Blade tip
16 Trailing edge
17 Leading edge
18 Blade core
19,19',23 Rotor bore
20 Blade inlet
21 Pressure side
22 Suction side
24 Rotor bore exit (diffuser shaped)
25,26 Web
27*a,b,c* Duct
28 Interface plenum
29 Plenum bleed
31 Rotor groove
α Diffuser angle made up of $\alpha_1$ and $\alpha_2$.
$\alpha_1$, $\alpha_2$ Diffuser angles
β Angle of deviation
δ Plenum gap
h Blade root height
w Maximum width
X Longitudinal axis
$A_1$,$A_2$,$A_3$ Cross section area
$m_1$,$m_2$,$m_3$ Mass flow
$m_b$ Plenum bleed flow
$m_s$ Cooling supply flow

What is claimed is:

1. A gas turbine comprising:

a rotor having a rotor groove and a rotor bore extending through the rotor, the rotor bore having a diffuser-shaped rotor bore exit; and a blade attached to the rotor, the blade including:

a blade tip having at least one dust hole;

an airfoil having a leading edge and a trailing edge extending along a longitudinal axis of the blade between a lower end of the airfoil and the blade tip;

a blade root disposed at the lower end of the airfoil and configured to be removably received by the rotor groove, the blade root including a blade inlet having a cross sectional area that exceeds a cross sectional area of the rotor bore in at least one direction; and a hollow blade core disposed in the airfoil and extending along the longitudinal axis of the blade between the blade root and the blade tip, the blade core configured to receive a cooling fluid from the rotor bore which is in fluid communication with the blade root at an interface between the rotor bore and the blade inlet, wherein a cross sectional area of the diffuser-shaped rotor bore exit covers the cross sectional area of the blade inlet at the interface, and wherein the cooling fluid enters the blade core through the blade inlet and exits the blade core through the at least one dust hole; and an interface plenum disposed at the interface of the blade inlet and the rotor bore exit between a bottom surface of the blade root and an upper surface of the rotor groove, wherein the interface plenum is configured to provide a plenum bleed of cooling fluid to an outside of the blade root at only one of a leading edge side or a trailing edge side of the interface plenum.

2. The gas turbine as recited in claim 1, wherein the blade core includes a plurality of parallel cooling fluid ducts each in fluid communication with the blade inlet and each having at least one dust hole disposed at the blade tip.

3. The gas turbine as recited in claim 2, wherein each of the plurality of parallel cooling fluid ducts has a plurality of dust holes disposed at the blade tip.

4. The gas turbine as recited in claim 2, wherein a plurality of longitudinally extending parallel webs disposed in the blade core split the blade core so as to form the plurality of parallel cooling fluid ducts.

5. The gas turbine as recited in claim 2, wherein each of the plurality of parallel cooling fluid ducts includes a flow cross sectional area and a cooling fluid mass flow configured to provide an optimal cooling of the blade.

6. The gas turbine as recited in claim 5, wherein the flow cross sectional area is normal to a direction of flow.

7. The gas turbine as recited in claim 1, wherein the rotor bore is disposed obliquely in an axial plane with respect to the longitudinal axis of the blade.

8. The gas turbine as recited in claim 7, wherein the rotor bore is disposed at a deviation angle with respect to the longitudinal axis in a range of 0° to 30°.

9. The gas turbine as recited in claim 1, wherein the diffuser-shaped rotor bore exit is one of symmetric and non-symmetric so as to include diffuser angles having an angular aperture in a range of 7° to 13°.

10. The gas turbine as recited in claim 1, wherein the blade root has a blade root height in a direction of the longitudinal axis and the interface plenum has a plenum gap, wherein a ratio of the plenum gap to the blade root height is in a range of 0.02 to 0.05.

11. The gas turbine as recited in claim 10, wherein the ratio of the plenum gap to the blade root height is 0.03.

12. The gas turbine as recited in claim 1, wherein the blade root has a blade root height in a direction of the longitudinal axis and the blade inlet has a width, wherein a ratio of the blade root height to the width of the blade inlet is in a range of 2 to 3.5.

13. The gas turbine as recited in claim 12, wherein the ratio of the blade root height to the width of the blade inlet is 2.5.

14. The gas turbine as recited in claim 5, wherein each of the flow cross sectional areas are within 25% of each other.

15. The gas turbine as recited in claim 5, wherein each of the cooling fluid mass flows are within 25% of each other.

16. The gas turbine as recited in claim 1, wherein at a first edge of the blade root the rotor groove receives a portion of the bottom surface of the blade root, the first edge including one of a leading edge or trailing edge of the blade root.

17. The gas turbine as recited in claim 16, wherein the interface plenum provides the plenum bleed of cooling fluid to a second edge of the blade root that is opposite the first edge.

* * * * *